United States Patent [19]

Uhlig

[11] Patent Number: 4,589,232

[45] Date of Patent: May 20, 1986

[54] MOUNTING FOR ROTARY GRINDING AND DRESSING TOOLS

[75] Inventor: Uwe Uhlig, Buchholz, Fed. Rep. of Germany

[73] Assignee: Hauni-Werke Körber & Co. KG, Hamburg, Fed. Rep. of Germany

[21] Appl. No.: 618,216

[22] Filed: Jun. 7, 1984

[30] Foreign Application Priority Data

Jun. 9, 1983 [DE] Fed. Rep. of Germany ..... 3320811
Jul. 2, 1983 [DE] Fed. Rep. of Germany ..... 3323928

[51] Int. Cl.[4] ..... B24B 45/00
[52] U.S. Cl. ..... 51/168; 51/262 A
[58] Field of Search ..... 51/168, 209 R, 262 A; 83/665, 666, 676; 409/231-234; 279/96, 16

[56] References Cited

U.S. PATENT DOCUMENTS

| | | | |
|---|---|---|---|
| 662,793 | 11/1900 | Kennedy | 51/168 |
| 790,099 | 5/1905 | Bath | 51/168 |
| 2,371,089 | 3/1945 | Weddell | 51/168 |
| 3,249,015 | 5/1966 | Schuster et al. | 409/234 |
| 3,554,080 | 1/1971 | Herrmann | 409/234 |
| 3,603,203 | 9/1971 | Rhodes | 409/232 |
| 3,699,843 | 10/1972 | Sweeny | 409/234 |

FOREIGN PATENT DOCUMENTS

| | | | |
|---|---|---|---|
| 2630047 | 1/1978 | Fed. Rep. of Germany | 409/232 |
| 3246168 | 7/1983 | Fed. Rep. of Germany . | |
| 96769 | 6/1982 | Japan | 51/168 |

*Primary Examiner*—Roscoe V. Parker
*Attorney, Agent, or Firm*—Peter K. Kontler

[57] ABSTRACT

At least one end portion of a grinding or dressing wheel has a frustoconical projection with a relatively short frustoconical external surface extending into a frustoconical recess which is provided therefor in one end portion of a rotary tool supporting spindle. The wheel is formed with an end face which is located in the region of the maximum-diameter portion of its external surface and abuts against a complementary end face on the spindle to fix the wheel in a preselected axial position wherein the wheel is held by a tension rod which extends into an axial passage of the spindle. The positions of the projection and recess can be reversed.

19 Claims, 3 Drawing Figures

MOUNTING FOR ROTARY GRINDING AND DRESSING TOOLS

BACKGROUND OF THE INVENTION

The present invention relates to machine tools in general, especially to grinding machines, and more particularly to improvements in means for mounting rotary material removing tools on rotary supporting members in the form of shafts, spindles and the like. Still more particularly, the invention relates to improvements in mounting means of the type wherein the material removing tool and the supporting member therefor are attached to each other end-to-end. The mounting means of the present invention can be used with particular advantage for separably securing grinding wheels, dressing wheels, profiling wheels, crushing rollers and like rotary members on spindles or analogous rotary supporting members.

Dressing apparatus which are used in or in conjunction with grinding machines often employ rotary spindles which serve to support dressing tools and are provided with relatively long and slender conical portions for introduction into complementary bores of dressing tools. A drawback of such mounting means is that the dressing tool cannot always be mounted in a predetermined axial position so that it is necessary to carry out secondary adjustments before the dressing tool is ready to treat the working surface of a grinding wheel. It is further necessary to safely secure the dressing tool against axial movement when the dressing apparatus is in actual use. Additional problems arise when the dressing tool is to be detached from its spindle because the relatively long and slender conical external and internal surfaces are normally moved into pronounced self-locking engagement with one another so that separation of such conical surfaces from one another requires the exertion of a large force.

In accordance with another known proposal, the spindle for a rotary dressing tool is provided with a cylindrical mandrel which must be inserted into a complementary large-diameter cylindrical bore of the dressing tool. Such proposal exhibits the drawback that, if the cylindrical bore of the dressing tool is not exactly coaxial with the cylindrical extension of the spindle, the tool is likely to wobble and to thus adversely influence the quality of the working surface of the workpiece (such as a grinding wheel) which is being treated thereby. Moreover, wobbling entails pronounced wear upon the parts and shortens the useful life of the dressing tool, of the spindle and of the grinding wheel.

A drawback which is common to each of the aforediscussed prior proposals is that conventional mounting of the dressing tool or grinding wheel on its spindle does not allow for convenient and rapid exchange of tools by automatic or highly automated tool changing devices. This is particularly important in automatic grinding machines wherein the frame often carries one or more magazines for spare grinding wheels and the machine further comprises an automatic tool changer which is designed to remove a spent or no longer used grinding wheel from the respective spindle, to transfer such wheel into the magazine and to deliver a fresh wheel from the magazine into the range of clamping means on the spindle. The complexity of the tool changing mechanism increases disproportionally with complexity of the means which is used to mount the tool on its spindle. The likelihood of establishment of a self-locking action between a slender conical external surface and an equally slender conical internal surface in a conventional mounting system for grinding wheels or analogous material removing tools is particularly troublesome insofar as automatic exchanges of grinding wheels are concerned. In fact, such types of mounting systems render it practically impossible to resort to a fully automatic tool changing device. In addition, the utilization of relatively long and slender conical surfaces prolongs the interval which is required for an exchange of tools because the tool must be moved axially through a considerable distance before it reaches a position from which it can advance in a direction toward the magazine.

OBJECTS AND SUMMARY OF THE INVENTION

An object of the invention is to provide a machine tool wherein the material removing tool or tools can be mounted on their supporting members in a novel and improved way which is especially suited to allow for a pronounced simplification and full automation of tool changing devices.

Another object of the invention is to provide a grinding or an analogous machine wherein a rotary grinding wheel, dressing wheel, crushing roller or a like tool can be mounted on its supporting spindle in a manner which ensures that the tool is safely held in an optimum axial position, that it can receive torque from its supporting member and that it can be readily and rapidly detached from the supporting member.

A further object of the invention is to provide a novel and improved method of reliably securing grinding wheels, dressing wheels and other types of rotary material removing tools on the spindles of grinding machines or other types of machine tools.

An additional object of the invention is to provide novel and improved material removing tools and novel and improved supporting means therefor fôr use in grinding machines and other types of machine tools.

Another object of the invention is to provide novel and improved mounting means which can be used to separably connect spindles and/or other types of rotary supporting members with grinding wheels, dressing wheels, crushing rollers and/or analogous material removing tools in a simple and space-saving manner as well as with a view to simplify the construction and mode of operation of a tool changing mechanism which is used in the machine tool to replace spent or no longer needed tools with fresh tools.

An additional object of the invention is to provide mounting means which can be installed in existing machine tools as superior substitutes for existing mounting means and to provide the mounting means with simple and compact systems for securely holding the applied tool or tools against wobbling and/or other stray movements.

Still another object of the invention is to provide novel and improved mounting means which can be used to support one or both end portions of a rotary material removing tool, such as a grinding wheel, a dressing wheel or the like.

A further object of the invention is to provide mounting means wherein the material removing tool can be attached to or detached from its support with the exertion of a relatively small force, wherein the tool is not likely to be locked to the supporting member as a result of resort to conical surfaces, and wherein the tool can be centered and held against wobbling and/or other stray movements in several different ways.

The invention is embodied in a machine tool, such as a grinding machine, which comprises a spindle or an analogous rotary supporting member having an end portion, and a rotary material removing member (e.g., a grinding wheel or a dressing wheel for a grinding wheel) having an end portion adjacent to the end portion of the supporting member. One of the two end portions has a recess with a coaxial frustoconical internal surface in the recess and the other end portion includes or constitutes a projection having frustoconical external surface which is complementary to the internal surface. The two surfaces are coaxial with the respective members and the projection is received in the recess so that the two surfaces abut against each other. The two members are further provided with end faces which are preferably normal to the respective axes and abut against each other when the frustoconical surfaces abut against one another to thereby locate the material removing member in a predetermined axial position with reference to the supporting member. The machine tool further comprises means for releasably holding the end faces in contact with one another. The maximum diameter of the external surface preferably slightly exceeds the maximum diameter of the internal surface, and the maximum-diameter portions of the two surfaces are preferably closely adjacent to the respective end faces, as considered in the axial direction of the respective members. The projection is preferably a relatively short conical frustum whose axial length need not exceed and can be considerably less than its maximum diameter.

If the material removing member is a dressing tool, the recess can be provided in the end portion of the supporting member.

The holding means can comprise a tension rod or an analogous element extending through an axial passage which is machined into or otherwise formed in the supporting member and/or the material removing member. The holding means is preferably arranged to bias the two members axially against one another, i.e., to bias the two end faces against each other.

If the material removing member is or comprises a grinding wheel, the projection can be provided on the supporting member (which can constitute or comprise a grinding spindle). In such machine tools, the material removing member can be provided with a ring which is installed in its recess and has the conical internal surface.

The supporting member of such machine tool can be further provided with a centering portion which extends forwardly from the projection and has a cylindrical external surface receivable with little play within a cylindrical internal surface bounding an extension or deepmost portion of the recess in the material removing member. Such machine tool can be further provided with means for admitting a pressurized fluid (e.g., compressed air) into the deepmost portion of the recess to expel foreign matter from the cylindrical internal surface and/or from the cylindrical external surface. The means for admitting pressurized fluid can include an axial bore in the supporting member and radially extending ports provided in the centering portion of such supporting member.

In each and every embodiment of the improved mounting means for the material removing member, the inclination or taper of the conical surfaces is preferably selected in such a way that these surfaces can abut against each other (while the two end faces abut against one another) without any or without appreciable self-locking action.

The material removing member can be mounted between two coaxial rotary supporting members. The second end portion of the material removing member is then adjacent to an end portion of the second supporting member and is centered and secured thereto in the same way as described above in connection with the first mentioned supporting member. The two supporting members are preferably mirror symmetrical to each other with reference to a plane which is normal to the axis of the material removing member.

The novel features which are considered as characteristic of the invention are set forth in particular in the appended claims. The improved machine tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
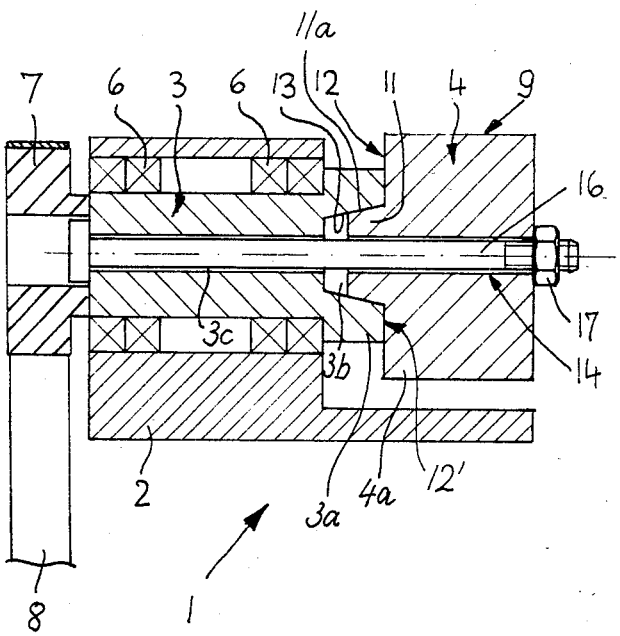
FIG. 1 is a fragmentary sectional view of a machine tool wherein one end portion of a rotary dressing tool is attached to the front end portion of a supporting member in the form of a driven spindle.

Referring first to FIG. 1, there is shown a rotary supporting member 3 in the form of a spindle which is surrounded by two pairs of antifriction bearings 6 installed in a stationary bearing block 2. The front (right-hand) end portion 3*a* of the spindle 3 has a frustoconical recess 3*b* bounded by a frustoconical internal surface 13 in contact with a complementary frustoconical external surface 11*a* provided on a frustoconical projection 11 forming part of the adjacent end portion 4*a* of a rotary material removing member 4, such as a dressing wheel. The structure which is shown in FIG. 1 forms part of a dressing apparatus 1 for grinding wheels and, to this end, the peripheral surface 9 of the wheel 4 is properly profiled (the profiling is not specifically shown in the drawing) so as to impart a complementary profile to the working surface of the grinding wheel when the latter requires a treatment by the tool 4. The spindle 3 is driven by a pulley 7 which receives motion from a toothed belt 8. The prime mover which drives the belt 8 is not shown in the drawing.

The end portion 3*a* of the spindle 3 is further formed with an end face 12' disposed in a plane which is normal to the axis of the spindle and abutting against a complementary end face 12 provided on the end portion 4*a* of the dressing wheel 4. The end faces 12 and 12' cooperate to fix the wheel 4 in a predetermined axial position relative to the spindle 3.

It will be noted that the frustoconical surfaces 11*a* and 13 are relatively short (the maximum diameter of the surface 11*a* exceeds the axial length of the projection 11) and the taper or inclination of such frustoconical surfaces is such that the self-locking action between these surfaces is nil or negligible. This is desirable and advantageous when the dressing wheel 4 is to be exchanged by an automatic tool changing device, not shown. The end face 12 is disposed at the level of the maximum-diameter portion of the frustoconical external surface 11*a*, as considered in the axial direction of the dressing wheel 4, and the end face 12' is located at the level of the maximum-diameter portion of the frustoconical internal surface 13, as considered in the axial direction of the spindle 3. The means for releasably holding the end faces 12, 12' in abutment with one another comprises an elongated tension rod 16 whose shank is disposed in an axial passage 3*c* of the spindle 3 and a registering axial passage 14 of the dressing wheel 4. The head at the left-hand end of the rod 16 abuts against the left-hand end face of the spindle 3 and the right-hand end portion of the rod 16 is externally threaded to take a nut 17 which bears against the right-hand end face of the dressing wheel 4 to thereby urge the end face 12 against the end face 12'. The diameter of the passage 14 only slightly exceeds the diameter of the shank of the tension rod 16.

The maximum diameter of the external surface 11*a* preferably slightly exceeds the maximum diameter of the internal surface 13 to ensure a predictable fit of the projection 11 in the recess 3*b* and to prevent any stray movements of the dressing wheel 4 relative to the spindle 3 when the latter is driven by the pulley 7 and the peripheral surface 9 of the wheel 4 treats the working surface of a grinding wheel, not shown.

Figure 2:
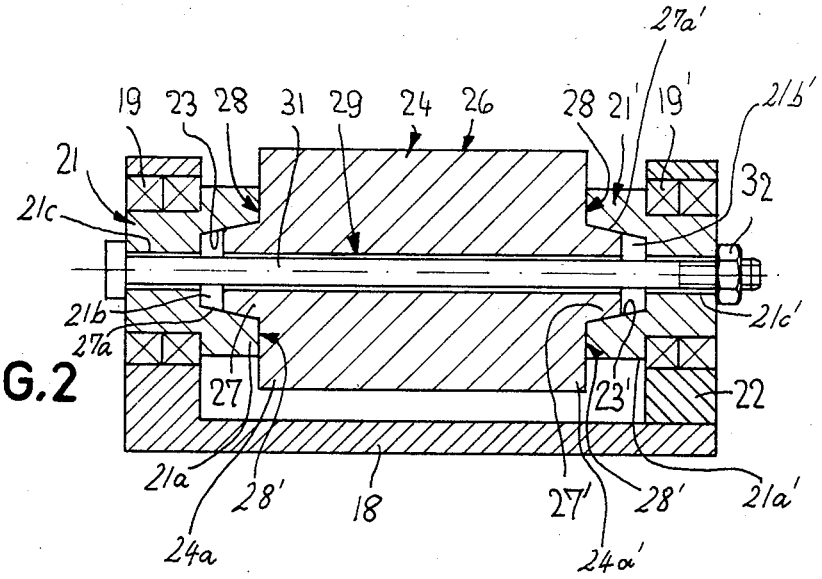
FIG. 2 is a similar fragmentary sectional view showing the manner of mounting a dressing tool between two coaxial spindles.

FIG. 2 shows a portion of a modified machine tool wherein a carrier 18 is provided with two mirror symmetrical supporting members 21, 21' each of which constitutes a rotary spindle. The carrier 18 is installed in a conventional grinding machine wherein the grinding wheel or wheels require periodic treatment by the peripheral surface 26 of a rotary dressing wheel 24. The spindles 21 and 21' respectively rotate in antifriction bearings 19, 19' which are installed in portions of the carrier 18. The latter comprises a guide 22 wherein the bearings 19' can be moved axially in order to disengage the respective spindle 21' from the corresponding end portion 24*a'* of the dressing wheel 24. This allows for replacement of the illustrated dressing wheel with a fresh wheel.

The end portions 21*a*, 21*a'* of the spindles 21, 21' are formed with recesses 21*b*, 21*b'* which are bounded by frustoconical internal surfaces 23 and 23'. The two end portions 24*a* and 24*a'* of the dressing wheel 24 have coaxial projections 27, 27' provided with frustoconical external surfaces 27*a*, 27*a'* which abut against the respective internal surfaces 23, 23'. The end faces of the dressing wheel 24 are shown at 28, and such end faces abut against the end faces 28' of the corresponding spindles 21, 21'. The means for holding the two end faces 28 in abutment with the respective end faces 28' comprises a tension rod 31 in the axial passage 29 of the dressing wheel 24 and in the coaxial passages 21*c*, 21*c'* of the respective spindles 21, 21'. The head of the rod 29 abuts against the left-hand end face of the spindle 21 and the nut 32, which meshes with the right-hand end portion of the rod 31, abuts against the right-hand end face of the spindle 21'. The manner in which at least one of the spindles 21, 21' is driven by a motor or the like is not specifically shown in FIG. 2. The diameter of the passage 29 only slightly exceeds the diameter of the shank of the tension rod 31.

The maximum diameters of the external surfaces 27*a*, 27*a'* preferably slightly exceed the maximum diameters of the respective internal surfaces 23, 23' to thus avoid wobbling or other stray movements of the dressing wheel 24 and also to ensure that the dressing wheel is accurately centered between the two spindles.

An important advantage of the structure which is shown in FIG. 2 is that the dressing wheel 24 can be removed with little loss in time in spite of the fact that each of its end portions is connected with a discrete supporting member. Moreover, the dimensions (as considered in the axial direction) of the dressing apparatus can be reduced to a minimum without risking wobbling and/or other stray movements of the dressing wheel and/or axial shifting of the dressing wheel in actual use. The two recesses 21*b*, 21*b'* and the cooperating projections 27, 27' ensure highly accurate centering of the dressing wheel 24 so that its suitably profiled peripheral surface 26 (the profiling is not specifically shown) can treat the working surfaces of grinding wheels with a very high degree of accuracy The structure of FIG. 2 (and also the structure of FIG. 1) can be used in machines and apparatus wherein the material removing tools are exchanged manually, semiautomatically or by resorting to fully automatic tool changing devices The exchange of tools is simple and consumes little time.

Figure 3:
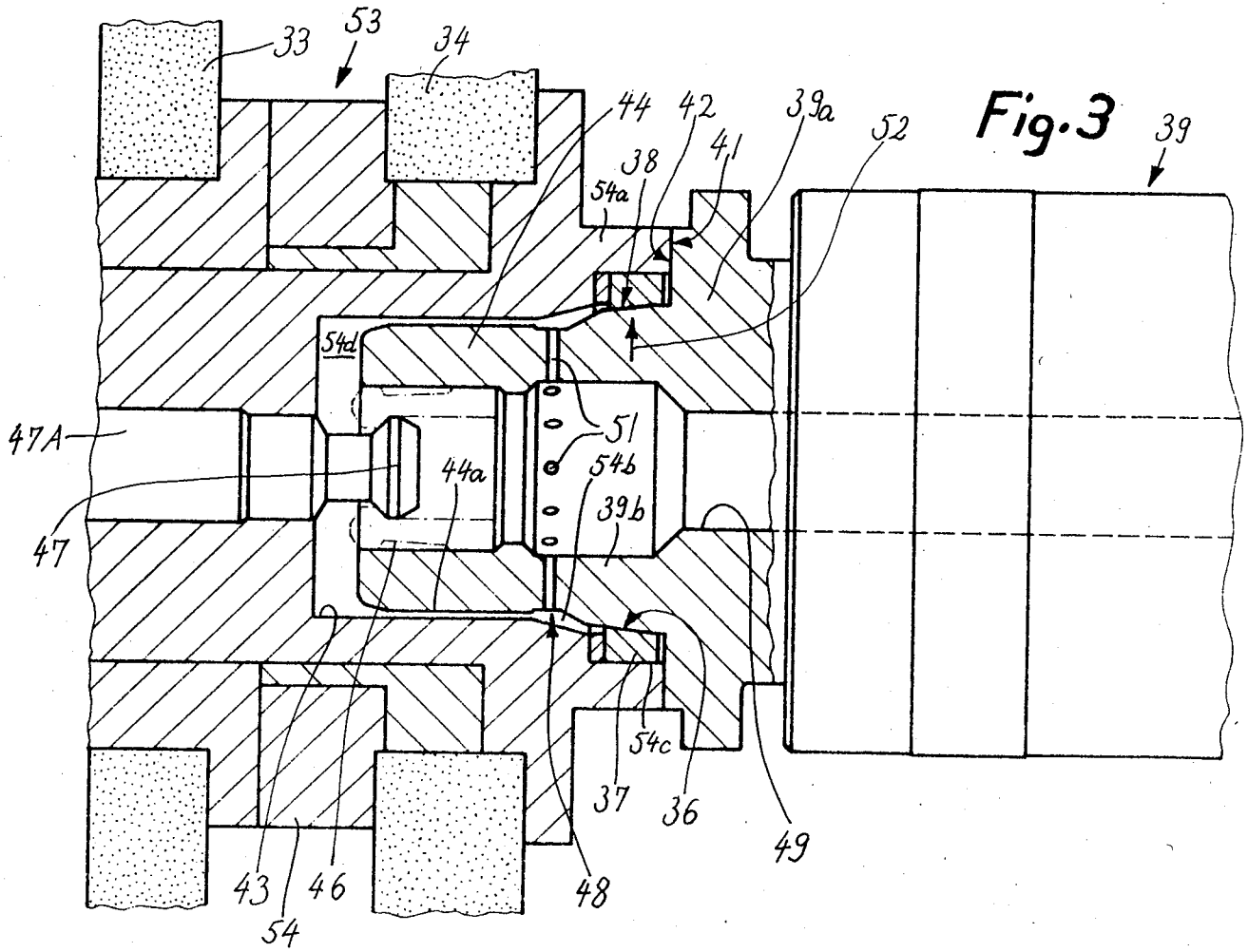
FIG. 3 is a fragmentary partly elevational and partly axial sectional view showing the manner of mounting the common hub of two coaxial grinding wheels on the front end portion of a grinding spindle.

FIG. 3 shows a portion of a grinding machine with a grinding spindle 39 which supports a material removing member 53 with two coaxial grinding wheels 33, 34. The right-hand end portion 54*a* of the hub 54 of the material removing member 53 has an axially extending recess 54*b* for a ring-shaped insert 37 having a frustoconical internal surface 36 in contact with the frustoconical external surface 38 on the frustoconical projection 39*b* on the left-hand end portion 39*a* of the spindle 39. The major part of the ring-shaped insert 37 is recessed into a groove 54*c* which is machined into the surface bounding the recess 54*b*.

The end portion 39*a* of the spindle 39 has an end face 42 which abuts against the adjacent end face 41 of the end portion 54*a* when the hub 54 is properly secured to and held on the spindle 39. The end faces 41, 42 are disposed in a plane which is normal to the common axis of the spindle 39 and hub 54 of the material removing member 53.

The projection 39*b* is provided with a cylindrical portion or extension 44 having a cylindrical external surface 44*a* which is received in the deepmost portion 54*d* of the recess 54*b*. The portion 54*d* is bounded by a cylindrical surface 43 which centers the portion 44 and thereby ensures accurate axial alignment of the spindle 39 with the material removing member 53.

The means for releasably holding the member 53 on the spindle 39 comprises pivotable grippers or claws 46 which are indicated by phantom lines and are mounted in the centering portion 44 of the projection 39*b*. The left-hand end portions of the claws 46 can be engaged with or disengaged from the head 47 of a tension rod or bolt 47A which is installed in and extends axially of the hub 54. The exact details of the manner in which the grippers 46 can be moved into and from engagement with the head 47, i.e., of the manner in which the hub 54 can be locked to or unlocked from the spindle 39, form no part of the present invention. Reference may be had, for example, to commonly owned copending U.S. patent application Ser. No. 455,884, now U.S. Pat. No. 4,528,743.

The grinding machine which embodies the structure of FIG. 3 further comprises means for admitting a compressed gaseous fluid (e.g., air) into the recess 54*b*, preferably against the internal surface 43 bounding the deepmost portion 54*d* of the recess 54*b*. The fluid admitting means comprises a suitable source of compressed air (e.g., a fan, not shown) which admits compressed air into an axial passage or bore 49 of the spindle 39. The passage 49 communicates with a set of radially extending ports 51 which are machined into the cylindrical portion 44 so that the jets of compressed air issuing at 48 can remove dust and/or other impurities from the surface 43 during insertion of cylindrical portion 44 into the deepmost portion 54*d* of the recess 54*b*. The cleaning action of such jets improves with progressing insertion of the conical portion 39*b* into the recess 54*b* due to progressive narrowing of the gap between the frustoconical surfaces 36 and 38. The flow of air which develops in the recess 54*b* also cleans the frustoconical surfaces 36, 38 to thus ensure that the wear upon such surfaces is minimal and also that the hub 54 can be properly centered on the spindle 39.

The arrow 52 denotes in FIG. 3 the direction of action of forces upon the internal surface 36 of the ring 37 when the grinding wheel 33 and/or 34 is in the process of removing material from a workpiece. The end faces 41, 42 cooperate to transmit torque from the spindle 39 to the hub 54 when the material removing member 53 is in actual use.

In the embodiment of FIG. 3, the axial length of the surfaces 36 and 38 is a minute fraction of their maximum diameters, and the taper of these surfaces is such that the establishment of self-locking action therebetween is highly unlikely or plain impossible. The end faces 41, 42 are disposed in the regions of the maximum-diameter portions of the respective frustoconical surfaces, as considered in the axial direction of the spindle 39 and hub 54.

It is clear that the positions of the recess 54*b* and projection 39*b* can be reversed. The same applies for the embodiments of FIGS. 1 and 2. It is presently preferred to provide the recess in an end face of the grinding wheel and to provide the recess in the end face of a spindle for a dressing wheel.

The provision of relatively short frustoconical external and internal surfaces is desirable and advantageous because the material removing member can be segregated from the supporting member in response to relatively short axial movement of one of these members relative to the other member and/or vice versa. Moreover, such short frustoconical surfaces are particularly desirable when the invention is embodied in a machine tool which is equipped with automatic or highly automated tool changing means. The absence of self-locking action between the external and internal frustoconical surfaces also contributes to simplicity and convenience of automatic tool exchange. On the other hand, the aforediscussed feature that the maximum diameter of the external frustoconical surface slightly exceeds the maximum diameter of the internal frustoconical surface contributes to more reliable centering of the material removing member on the supporting member as well as to prevention of any stray movements which could affect the material removing operation irrespective of whether a dressing wheel is called upon to remove material from the working surface of a grinding wheel or a grinding wheel is called upon to remove material from a workpiece.

The end faces of the two members ensure exact and predictable axial positioning and retention of the material removing member irrespective of the frequency at which the material removing member is detached from and reattached to the supporting member. Such exact axial positioning is especially important in connection with dressing wheels and analogous (e.g., crushing) tools. Moreover, the provision of end faces is desirable when the invention is embodied in a machine tool with automatic tool changing means because the operation of the tool changing means is simplified if the tool which must be exchanged is invariably held in a predetermined axial position. Still further, and since the abutting end faces can be designed to transmit torque between the supporting member and the material removing member, the frustoconical surfaces merely take up radial stresses (note the arrow 52 in FIG. 3) which develop when the material removing member is in actual use.

An additional advantage of the improved mounting system is that, if the invention is embodied in means for mounting a dressing wheel or the like, the diameter of the dressing wheel can be held to a minimum, especially if the axial passage (such as 14 or 29) therein has a relatively small diameter. The utilization of relatively small profiling tools for grinding wheels greatly reduces the cost of such tools. Conventional profiling tools for grinding wheels are normally formed with large conical recesses or large-diameter axial bores which renders it necessary to increase the outer diameters of such tools. As mentioned above, the diameter of the passage 14 or 29 need not appreciably exceed the diameter of the shank of the respective tension rod 16 or 31.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine tool, particularly in a grinding machine, the combination of a rotary supporting member having an end portion; a rotary material removing member having an end portion, one of said end portions having a recess and a conical internal surface in said recess and the other of said end portions including a projection having a conical external surface complementary to said internal surface, the maximum diameter of said external surface exceeding the maximum diameter of said internal surface and the length of said projection being less than the maximum diameter of said external surface, said surfaces being coaxial with the respective members and said projection constituting a relatively short conical frustum and being received in said recess so that said surfaces abut against one another, said members further having end faces which abut against each other when said surfaces abut against one another, the maximum-diameter portions of said surfaces being closely adjacent to the respective end faces, as considered in the axial direction of the respective members; and means for releasably holding said end faces in contact with one another.

2. The combination of claim 1, wherein said material removing member includes a dressing tool and said projection is provided on said dressing tool.

3. The combination of claim 1, wherein said material removing member has an axially extending passage and said holding means comprises an element extending through said passage.

4. The combination of claim 3 wherein said element includes a tension rod and said holding means is arranged to bias said end faces against one another.

5. The combination of claim 1, wherein said end faces are disposed in a plane making an angle of 90 degrees with the common axis of said members.

6. The combination of claim 1, wherein said supporting member comprises a grinding spindle and said material removing member comprises a grinding wheel, said projection being provided on said supporting member.

7. The combination of claim 6, wherein said material removing member has a ring which is disposed in said recess and said internal surface is provided in said ring.

8. The combination of claim 6, wherein the projection of said supporting member comprises a centering portion and said recess has a portion which receives said centering portion when said end faces abut against one another.

9. The combination of claim 8, wherein said centering portion has a cylindrical external surface.

10. The combination of claim 8, further comprising means for admitting a pressurized fluid into said portion of said recess.

11. The combination of claim 1, wherein the inclination of said surfaces is such that they abut against each other without any or without appreciable self-locking action.

12. The combination of claim 1, wherein said material removing member further comprises a second end portion and further comprising a second rotary supporting member having an end portion adjacent the second end portion of said material removing member, one of said adjacent end portions having an additional recess and a conical internal surface in said additional recess and the other of said adjacent end portions including a projection having a conical external surface complementary to and extending into the internal surface in said additional recess, the second end portion of said material removing member and the end portion of said second supporting member having end faces which abut against each other when the internal surface in said additional recess receives the respective external surface, such surfaces being coaxial with one another and with the other surfaces when they extend into and abut against one another.

13. The combination of claim 12, wherein said supporting members are mirror symmetrical to one another with reference to a plane which is normal to the axis of said material removing member 14. In a machine tool, particularly in a grinding machine, the combination of a rotary supporting member comprising a grinding spindle and having an end portion; a rotary material removing member comprising a grinding wheel and having an end portion, the end portion of said material removing member having a recess and a conical internal surface in said recess and the end portion of said supporting member including a projection having a conical external surface complementary to said internal surface, said surfaces being coaxial with the respective members and said projection being received in said recess so that said surfaces abut against one another, said members further having end faces which abut against each other when said surfaces abut against one another, said projection comprising a centering portion and said recess having a portion which receives said centering portion when said end faces abut against one another; means for admitting a pressurized fluid into said portion of said recess, comprising substantially radially extending ports provided in said centering portion; and means for releasably holding said end faces in contact with one another.

15. The combination of claim 14, wherein the maximum diameter of said external surface slightly exceeds the maximum diameter of said internal surface.

16. The combination of claim 15, wherein the maximum-diameter portions of said surfaces are closely adjacent to the respective end faces, as considered in the axial direction of the respective members.

17. The combination of claim 16, wherein said projection is a relatively short conical frustum.

18. The combination of claim 17, wherein the axial length of said projection is less than the maximum diameter of said external surface.

19. In a machine tool, particularly a grinding machine, the combination of a rotary supporting member having an end portion; a rotary material removing member having an end portion, one of said end portions having a recess and a conical internal surface in said recess and the other of said end portions including a projetion having a conical external surface complementary to said internal surface, said surfaces being coaxial with the respective members and said projection being received in said recess so that said surfaces abut against one another, said members further having end faces which abut against each other when said surfaces abut against one another, said projection comprising a centering portion and said recess having a portion which receives said centering portion when said end faces abut against one another; means for admitting a pressurized fluid into said portion of said recess so as to expel foreign matter, if any, from at least one of said surfaces; and means for releasably holding said end faces in contact with one another.

* * * * *